US009103141B2

(12) United States Patent
Hesselbäck

(10) Patent No.: US 9,103,141 B2
(45) Date of Patent: Aug. 11, 2015

(54) CONNECTION MEANS AND LOCK MOUNTING DEVICE WITH SUCH CONNECTION MEANS

(75) Inventor: Jimmy Hesselbäck, Stockholm (SE)

(73) Assignee: ESSEC AB, Stockholm (SE)

( * ) Notice: Subject to any disclaimer, the term of this patent is extended or adjusted under 35 U.S.C. 154(b) by 0 days.

(21) Appl. No.: 13/511,843

(22) PCT Filed: Jul. 9, 2010

(86) PCT No.: PCT/SE2010/050797

§ 371 (c)(1),
(2), (4) Date: Sep. 13, 2012

(87) PCT Pub. No.: WO2011/065887

PCT Pub. Date: Jun. 3, 2011

(65) Prior Publication Data

US 2013/0004260 A1 Jan. 3, 2013

(30) Foreign Application Priority Data

Nov. 26, 2009 (SE) ..... 0950898

(51) Int. Cl.
*E05B 15/02* (2006.01)
*E05B 17/20* (2006.01)
*E05B 9/08* (2006.01)

(52) U.S. Cl.
CPC ..... *E05B 17/2084* (2013.01); *E05B 9/08* (2013.01); *E05B 15/02* (2013.01); *E05B 17/2088* (2013.01)

(58) Field of Classification Search
USPC ..... 292/357, DIG. 53, DIG. 54
See application file for complete search history.

(56) References Cited

U.S. PATENT DOCUMENTS

| | | | | | |
|---|---|---|---|---|---|
| 2,576,511 | A * | 11/1951 | Jewett | 16/402 |
| 4,296,619 | A * | 10/1981 | Widen | 70/451 |
| 4,699,409 | A | 10/1987 | Newman | |
| 5,057,830 | A | 10/1991 | Eisermann | |
| 5,141,351 | A * | 8/1992 | Imai | 403/171 |
| 5,498,093 | A * | 3/1996 | Imai | 403/171 |
| 6,698,260 | B2 * | 3/2004 | Su | 70/134 |

FOREIGN PATENT DOCUMENTS

| | | |
|---|---|---|
| EP | 0 364 878 | 4/1990 |
| SE | 419 466 | 8/1981 |

OTHER PUBLICATIONS

International Search Report issued on Feb. 28, 2011 in International Application No. PCT/SE2010/050797 filed Jul. 9, 2010.

* cited by examiner

*Primary Examiner* — Mark Williams
(74) *Attorney, Agent, or Firm* — Drinker Biddle & Reath LLP

(57) ABSTRACT

Connection means for the mounting of lock details arranged to connect a first element with a second element, which two elements surround a third element, which connection means comprises a first screw means, which is provided with a threaded part to co-operate with a corresponding threaded part in a second screw means to provide an interconnection of the first element and the second element. The connection means comprises an intermediate part, which, in its first end, is provided with a first thread, which is arranged to co-operate with the first screw means for the connection to said first element, and which intermediate part, by its second end, is connected to the second element, the intermediate part in addition being provided with a third thread orientated perpendicular to said first thread, the third element being mounted to the third thread of the intermediate part by an element fixation means.

4 Claims, 5 Drawing Sheets

CONNECTION MEANS AND LOCK MOUNTING DEVICE WITH SUCH CONNECTION MEANS

CROSS REFERENCE TO RELATED APPLICATIONS

This application is a National Stage of International Application No. PCT/SE2010/050797 filed Jul. 9, 2010, and which claims benefit of Swedish Patent Application No. 0950898-7 filed Nov. 26, 2009, both of which are herein incorporated by reference in their entirety.

TECHNICAL FIELD

The present invention relates to a connection means for a mounting device, preferably for a lock mounting device for the reinforcement of door leaves in the area of a mounted lock case.

BACKGROUND OF THE INVENTION

Existing locks are mounted in a door by a lock case/lock housing of a lock being bolted in the door leaf by two woodscrews through a selvage connected with the lock case. By such an arrangement, the lock case is anchored in the door leaf only by these screws, the breaking security being relatively low for such locks. Accordingly, existing lock mountings constitute a weakening in the door leaf by the same having been provided with a recess for the lock case.

THE OBJECT OF THE INVENTION

The object of the present invention is to provide a mounting element above all for a lock mounting device as well as a lock mounting device in order to increase the breaking security at the attachment of a lock case in a door leaf.

The object is further to provide improved lock mounting devices to make burglary by breaking impact more difficult in the area of the lock case.

A further object is to, by means of such a mounting element, stabilize the lock case in the door leaf by an improved mounting.

In addition, the object of the invention is to provide an improved burglary protection by a lock mounting device at a door that is difficult to force using breaking tools.

SUMMARY OF THE INVENTION

By the present invention, as the same appears in the independent claims, the above-mentioned objects are met, said disadvantages having been eliminated. Suitable embodiments of the invention are defined in the dependent claims.

In its general wording, the invention concerns a connection means, preferably for the mounting of lock details, which connection means is arranged to connect a first element with a second element, which two elements surround a third element. The connection means comprises a first screw means, which is provided with a threaded part intended to co-operate with a corresponding threaded part in a second screw means in order to provide an interconnection of the first element and the second element. The connection means comprises an intermediate part, which, in its first end, is provided with a first thread, which is arranged to co-operate with the first screw means for the connection to said first element. The intermediate part is further, by its second end, connected to the second element, the intermediate part in addition being provided with a third thread orientated perpendicular to said first thread, the third element being mounted to the third thread of the intermediate part by an element fixation means.

In a number of embodiments, the second screw means consists of said intermediate part, which is provided with a head, which co-operates with a hole in the second element in order to provide said joint between the elements.

In further embodiments, the element fixation means is provided with a security head that can rotate freely on a smooth cylindrical shoulder connecting against the head.

The invention concerns further a connection means, preferably for the mounting of lock details. The connection means is arranged to connect a first element, e.g., an inner plate of a door lock, with a second element, e.g., an outer plate of a door lock. These two elements surround a third element, e.g., a lock case of a door lock. The connection means comprises a first screw means, which is provided with a threaded part intended to co-operate with a corresponding threaded part in a second screw means fixedly connected with the second element. The connection means comprises further an intermediate part, which, in its first end, is provided with a first thread, which is arranged to co-operate with the first screw means for the connection to said first element. In its second end, the intermediate part is provided with a second thread, which is arranged to co-operate with the fixedly connected second screw means of the second element for the connection of the connection means to said second element. In addition, the intermediate part is provided with a third thread orientated perpendicular to said first and second thread, the third element being mounted to the intermediate part by an element fixation means. The first thread and the second thread are orientated along the same centre axis.

In one embodiment, the third thread of the intermediate part is an internal thread in a through hole extending through the intermediate part. In this connection, the centre axis of the third thread intersects the centre axis of the first and the second thread. It is also feasible that the centre axis of the third thread lies beside the centre axis of the first and the second thread.

In a further embodiment, the first thread of the intermediate part is an internal thread co-operating with an external thread of the first screw means.

In a further embodiment, the second thread of the intermediate part is an external thread co-operating with an internal thread of the second screw means.

In a further embodiment, the second thread of the intermediate part is an internal thread co-operating with an external thread of the second screw means.

In a further embodiment, the first thread of the intermediate part is an external thread co-operating with an internal thread of the first screw means.

In a further embodiment, the second thread of the intermediate part is an external thread co-operating with an internal thread of the second screw means.

In a further embodiment, the second thread of the intermediate part is an internal thread co-operating with an external thread of the second screw means.

Accordingly, the two ends of the intermediate part can be formed either as an externally threaded pin or as an internally threaded sleeve, alternatively that one end is formed with an externally threaded pin and the other end is formed with an internally threaded sleeve.

In a further embodiment, a locking screw is placed in the first thread when the same is internal, the locking screw being arranged to be screwed into said third thread, for instance in order to lock a screwed-in means in this third thread.

In a further embodiment, the element fixation means comprises an externally threaded screw, which is arranged to be screwed into said third thread.

In a further embodiment, the intermediate part is provided with alignment means, for instance in the form of screw driver slots, in order to allow a turning of the intermediate part in relation to said first, second and third elements.

In a further embodiment, the alignment means is placed on the first end of the intermediate part.

Further, the invention concerns a lock mounting device comprising a connection means, which is arranged to connect an inner plate with an outer plate of a door lock. The plates are mounted on both sides of a door leaf between which plates and in said door leaf a lock housing having a selvage is mounted and where this connection means is formed according to the invention mentioned above or according to any one of the embodiments mentioned above. The use of such a connection means in this way at a door lock provides a significant improvement of the security of the lock upon an attempted burglary by breaking off the lock case/lock housing from the door leaf.

In one embodiment of the lock mounting device, accordingly, the first element is the inner plate, the second element is the outer plate, and the third element is the lock housing with the selvage.

In a further embodiment, the selvage is connected to the intermediate part of the connection means by the element fixation means, in order to fix the lock housing, selvage, inner plate, and outer plate to each other in the door leaf. This embodiment represents a very good fixation of the lock housing in the door leaves and plates and depends on a connection means provided with said third thread.

In a further embodiment, the element fixation means is connected perpendicular to and through the selvage to the third thread of the intermediate part.

In a further embodiment, the element fixation means is formed as a threaded screw arranged to be screwed into the third thread of the intermediate part, the head of the screw in the screwed-in position being countersunk in the selvage. This embodiment can then be used together with conventional striking plates but provides, nevertheless, a high security.

In a further embodiment, the element fixation means is formed as a threaded screw arranged to be screwed into the third thread of the intermediate part, the head of the screw being formed with a collar situated outside the selvage in the entirely screwed-in position, this collar being arranged to engagingly co-operate with a security striking plate mounted in a doorframe, by the collar being arranged to be inserted through a slot in the security striking plate in order to prevent a removal of the selvage from the security striking plate when the collar is inserted through the slot. This embodiment provides a further improvement of the safety upon burglary by the possibility of breaking apart the lock case and the striking plate being decreased considerably.

In a further embodiment, the collar is cylindrically formed with a plane outwardly facing surface, the collar being connected to a cylindrical spacing element outside the selvage, which spacing element has a diameter that exceeds the diameter of the screw thread and in addition co-operates with the security striking plate.

In a further embodiment, at least one anchor screw is arranged for the connection of said inner plate to an anchor thread fixedly arranged on the inside of the outer plate, the anchor screw extending through the lock case. In this connection, the lock case is further fixed to the door leaves and the plates.

Several security advantages will be achieved by the present invention, among others increased torsional rigidity in the entire lock assembly. In this connection, the selvage will not "yield" and be flush with the lock case upon an attempted burglary. This great advantage occurs even if coupling together is not made by a security striking plate but by a conventional screw having a head and a thread as element fixation means that co-operates with the connection means. Also upon, e.g., screwing off of the inner plate, the outer plate does still not come loose as the same is retained by the element fixation means that is screwed through the connection means.

In the application of a lock mounting device according to the invention, by all mounting elements in co-operation, a lock design that makes burglary more difficult is obtained.

BRIEF DESCRIPTION OF THE DRAWINGS

Now, the invention will be described in more detail, reference being made in connection with the accompanying drawing figures. The drawing figures show only explanatory sketches intended to facilitate the understanding of the invention.

DESCRIPTION OF THE INVENTION

Figure 1:
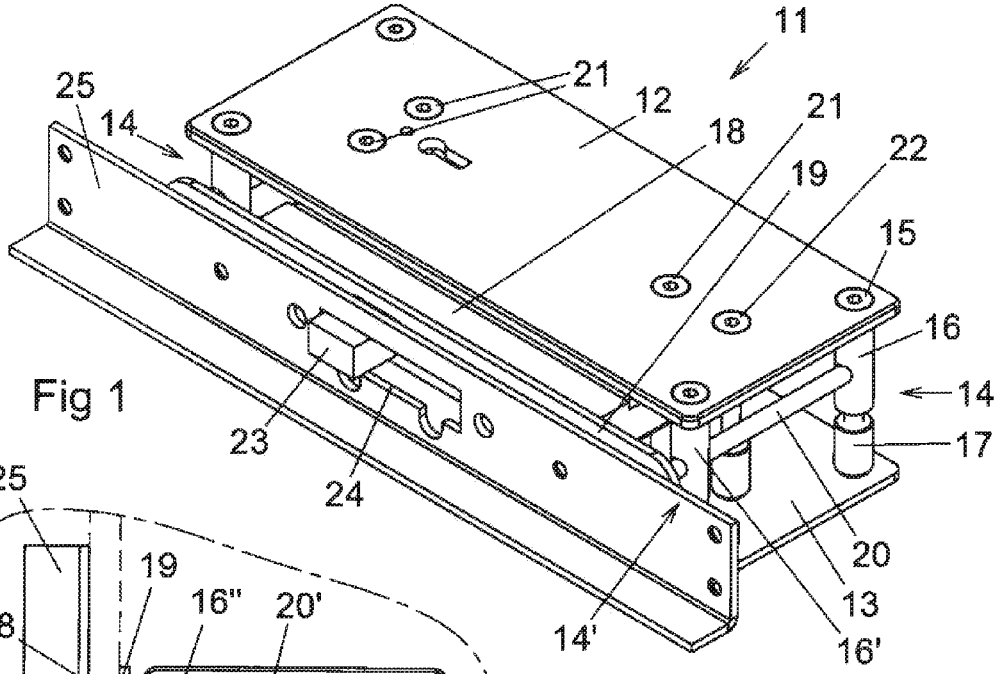
FIG. 1 shows a perspective view of a first embodiment of a lock mounting device provided with a connection means according to the invention.

FIG. 1 shows a lock mounting device 11, which comprises a first element 12 in the form of an inner plate as well as a second element 13 in the form of an outer plate of a door lock. These two elements 12, 13 are interconnected by a connection means 14, which comprises a first screw means 15, which is screwed-in in an intermediate part 16, which in turn is screwed-in in a second screw means 17 that is fixedly connected with the second element 13. The embodiment according to FIG. 1 comprises four connection means placed individually in the respective corner of the inner plate and outer plate, respectively. Between the first element 12 and the second element 13, a third element 18 in the form of a lock housing is placed. On this third element 18, i.e., lock housing according to FIG. 1, a selvage 19 is fixedly arranged. Through the selvage 19, an element fixation means 20 extends, which connects the third element 18, i.e., the lock housing, via the selvage 19 with the intermediate part 16 of the connection means 14 and thereby also with the two plates 12, 13. As shown in the figure, the element fixation means 20 extends also through the intermediate part 16' of a second connection means 14' mounted in a corresponding way. Further, three anchor screws 21 connect the two plates 12, 13 with each other as well as also fix the lock housing by the anchor screws extending through the lock housing. In addition, the two plates 12, 13 are connected by an abutment screw 22, which constitutes a mounting support for the lock housing that abuts against this abutment screw. The figure also shows the lock bolt 23 of the lock mounted in the lock case, which lock bolt in the locked position co-operates with a bolt slot 24 in a striking plate 25 in a conventional way.

Figure 2:
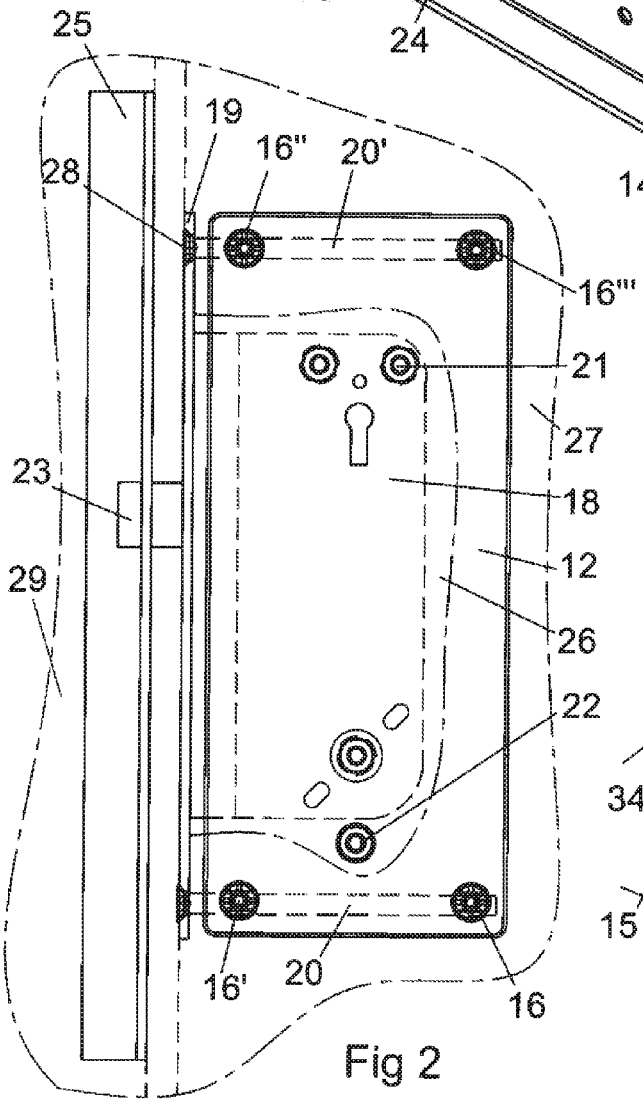
FIG. 2 shows a side view of a lock mounting device according to FIG. 1 mounted in a door leaf.

FIG. 2 shows a lock housing 18 mounted in a space 26 in a door leaf 27 between the plates, the inner plate 12 of which is shown in the figure. The lock housing 18 is fixed to the plates by the selvage 19 of the lock housing being bolted to the connection means 16, 16', 16", 16'" via the element fixation means 20, 20'. Accordingly, the selvage 19 and the lock housing 18 are fixed to the plates by two element fixation means through two connection means each. According to the figure, the heads 28 of the element fixation means are countersunk in the selvage 19. The figure also shows that the lock bolt 23 co-operates with the striking plate 25, which is mounted in a doorframe 29. Also anchor screws 21 and an abutment screw 22 are shown in the figure.

Figure 3:
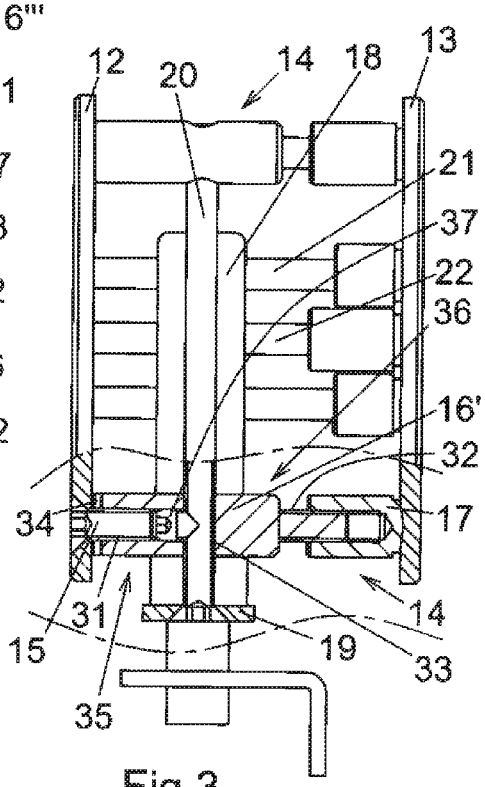
FIG. 3 shows an end view partly in section of FIG. 1 with a connection means including the intermediate part thereof.

FIG. 3 shows an end view partly in section where the lock housing 18 is mounted between the inner plate 12 and the outer plate 13. The connection means 14 that interconnects the plates comprises the intermediate part 16', which is provided with a first thread 31 in a first end 35 of the intermediate part, a second thread 32 in a second end 36 of the intermediate part, and a third thread 33 through the intermediate part perpendicular to the first and the second thread. The connection means also comprises the first screw means 15 for the connection of the inner plate to the intermediate part and the second screw means 17 for the connection of the intermediate part to the outer plate 13. The second screw means 17 is fixedly connected with the outer plate 13 by it being butt-welded to the inside of the outer plate. The second screw means 17 may also consist of a thread sleeve or thread pin of varying dimensions that is introduced from the outside of the outer plate.

The mounting of the connection means is carried out by the intermediate part 16' with its second thread 32, placed on the second end 36 of the intermediate part, being screwed into the second screw means 17 and adjusted rotation-wise so that the element fixation means 20 can be screwed into the third thread 33 of the intermediate part. The adjustment of the intermediate part is made by means of an alignment means 34 in the form of a screw driver slot in the first end 35 of the intermediate part. Further, the element fixation means 20 is screwed in through the selvage 19 and into the third thread 33 of the intermediate part in order to fix the turning position of the intermediate part. Next, the first screw means 15 is mounted by being inserted through a hole in the inner plate 12 and screwed into the first thread 31 of the intermediate part. In doing so, the lock housing is fixed to the plates by the fact that the selvage 19 of the lock housing has been bolted by the element fixation means 20 in the connection means together with the connection means having fixed the inner plate to the outer plate. In the figure, the element fixation means 20 is in addition screwed in through two connection means 14, 14', the third threads of the intermediate parts of which are in line with each other.

Further, FIG. 3 shows that the connection means 16' may be provided with a locking screw 37, which is externally threaded and screwed in to bottom in the first thread 31 so that the tip or end of the locking screw is pressed against the element fixation means 20 that is screwed-in in the third thread 33 in the intermediate part. In such a locking screw arrangement of the intermediate part, accordingly the first thread runs into the second thread. In addition, FIG. 3 shows that the plates 12, 13 also are connected with the anchor screws 21 and an abutment screw 22.

Figure 4:
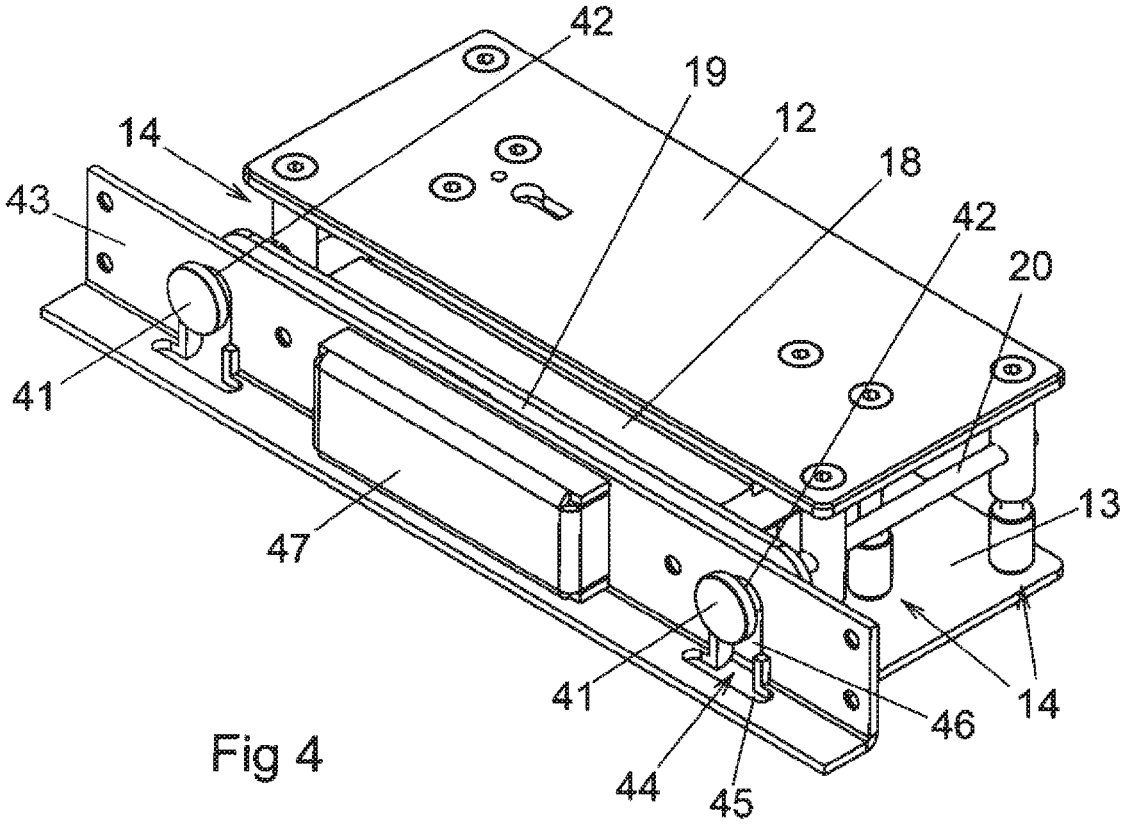
FIG. 4 shows a perspective view of a second embodiment of a lock mounting device provided with a connection means according to the invention.

FIG. 4 shows a second embodiment example of a lock mounting device, which in a corresponding way as described previously in connection with FIG. 1 comprises a first element 12, a second element 13, connection means 14 as well as an intermediate third element 18, which is connected with the first and the second element by having an element fixation means 20 screwed-in in two connection means 14. The head of the element fixation means 20 is outermost formed with a collar 41 that is attached on a cylindrical spacing element 42, which in turn abuts against the selvage 19 connected to the third element. In other respects, the element fixation means 20 is formed as previously described. In order to screw on this element fixation means 20, either the collar or the spacing element is provided with screw driver slots or key grips (not shown) for the connection of a tool. The collar 41 and spacing element 42 of the element fixation means 20 are formed to co-operate with a security striking plate 43 mounted in a doorframe. The security striking plate is formed with a slot 44, which is formed with a first opening 45 through which the collar can be inserted from the side and a second opening 46 into which the spacing element simultaneously can be inserted. When the lock mounting device is mounted in the door leaf and the security striking plate is mounted in the doorframe and the door is closed, the collar 41 of the element fixation means 20 has assumed the position shown in the figure, the security plate securing the element fixation means 20 and thereby the lock mounting device to the doorframe. This contributes to a considerably improved security against burglary by breaking apart locks and striking plates.

The embodiment in FIG. 4 also shows that the security striking plate 43 is provided with an integrated bolt housing 47 into which the lock bolt runs when the lock is being locked.

Figure 5:
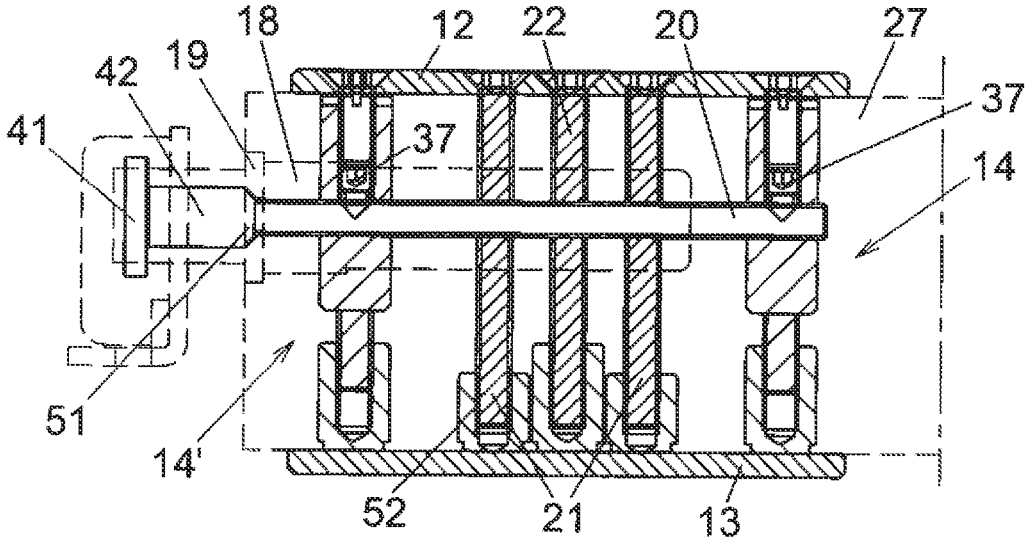
FIG. 5 shows a section view through two connection means including intermediate parts according to FIG. 4.

FIG. 5 shows in section the element fixation means 20 in the lock mounting device according to the security arrangement shown in FIG. 4. The element fixation means 20 is inserted through the selvage 19 and screwed in through a first and a second connection means 14, 14'. As described previously, the connection means connect an inner plate 12 with an outer plate 13 mounted in such a way on both sides of a door leaf 27 in which the lock housing 18 with the selvage 19 thereof is mounted. The figure shows more clearly that the element fixation means 20 is formed as a screw, the head of which is provided with the collar 41 that is placed on the cylindrical spacing element 42, which in turn abuts against a conical countersink 51 in the selvage 19. Further, there are shown the anchor screws 21 and an abutment screw 22. All screws are screwed in from the inner plate 12 into anchor threads 52 on the inside of the outer plate. The figure also shows that the two connection means 14, 14' are provided with a respective locking screw 37 in order to lock the element fixation means 20 in the connection means 14, 14' in accordance with FIG. 3.

Figure 6:
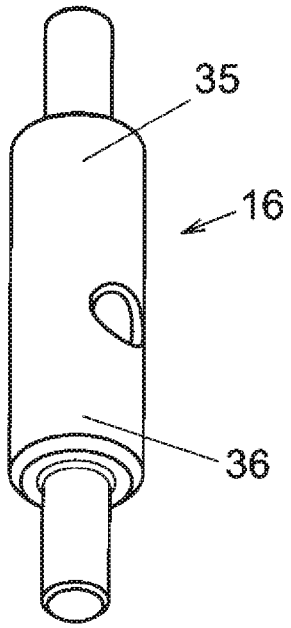
FIG. 6 shows a second embodiment of the intermediate part of a connection means.

FIG. 6 shows a second embodiment of the intermediate part 16 of a connection means, which, in its first end 35, is provided with a pin having an external first thread and, in its second end 36, also is provided with a pin having an external second thread.

Figure 7:
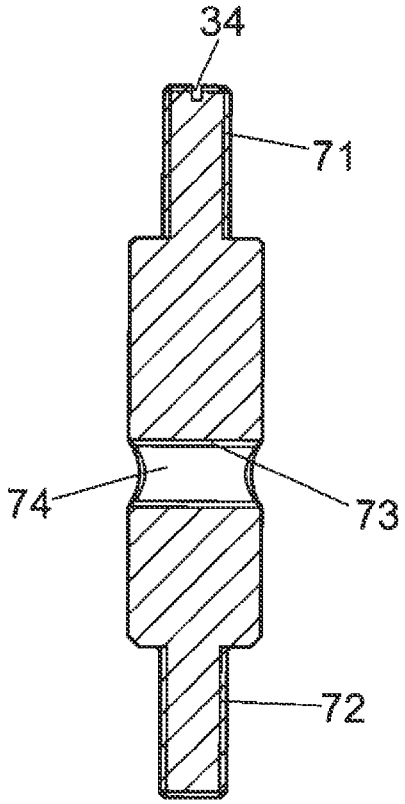
FIG. 7 shows an axial section through the intermediate part according to FIG. 6.

In FIG. 7, the intermediate part in FIG. 6 is shown in section with the first thread 71 thereof and the second thread 72 thereof. In addition, the third thread 73 of the intermediate part is shown, which is orientated perpendicular to the first and the second thread in a through hole 74. The centre axes of the first thread 71 and the second thread 72 coincide with each other and intersect the centre axis of the third thread 73. Also the intermediate part according to this embodiment may be provided with alignment means 34 in the upper end surface of a pin.

Figure 8:
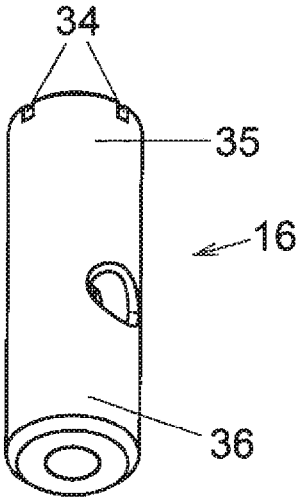
FIG. 8 shows a third embodiment of the intermediate part of a connection means.

FIG. 8 shows a third embodiment of the intermediate part 16 of a connection means, which, in its first end 35, is provided with a sleeve having an internal first thread and, in its second end 36, also is provided with a sleeve having an internal second thread. The first end of the intermediate part is provided with alignment means 34 in the form of two screw driver slots.

Figure 9:
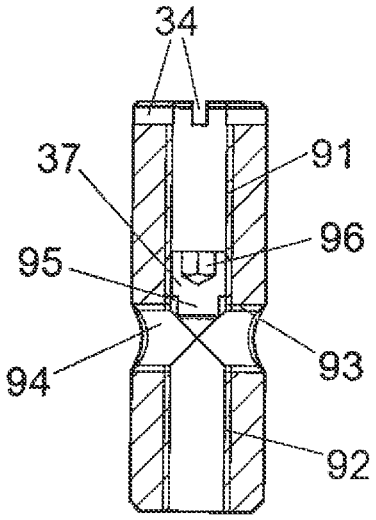
FIG. 9 shows an axial section through the intermediate part according to FIG. 8.

In FIG. 9, the intermediate part in FIG. 8 is shown in section with the first thread 91 thereof and the second thread 92 thereof. In addition, the third thread 93 of the intermediate part is shown, which is orientated perpendicular to the first and the second thread in a through hole 94. The centre axes of the first thread 91 and the second thread 92 coincide with each other and intersect the centre axis of the third thread 93. A locking screw 37 is screwable into the first thread 91 all the way down until the tip 95 thereof penetrates into the third thread 93 in order to in the same be able to lock a screwed-in means, e.g., an element fixation means. Also the locking screw 37 is provided with recesses, in the figure shown as a hexagonal grip 96, to be screwed down in the first thread 91. In the embodiment examples of the intermediate part where the first thread is internal, the locking screw 37 may be formed in the same way. Also the alignment means 34 are shown in the figure.

The intermediate parts of connection means that have been shown in the embodiments are formed as sleeve-pin according to FIGS. 1-5 and pin-pin according to FIGS. 6-7 as well as sleeve-sleeve according to FIGS. 8-9. In case the first end of the intermediate part is provided with a threaded pin, the same co-operates with a corresponding threaded sleeve screw as a first screw means to be screwed in through the inner plate. In case the second end of the intermediate part is provided with a threaded sleeve, this sleeve co-operates with a corresponding threaded pin that is welded on the inside of the outer plate. Within the scope of the invention, the intermediate part of the connection means may also be formed as pin-sleeve, i.e., a reverse design in relation to the intermediate part that has been shown in FIGS. 1-5.

The following two described embodiments of intermediate parts are formed with a plane head, which directly co-operates with the previously described outer plate 13 in such a way that the intermediate part is connected from the outside of the outer plate through a plate hole. The plate hole of the outer plate may preferably be provided with an orientation surface co-operating with a corresponding orientation surface at the head of the intermediate part.

Figure 10:
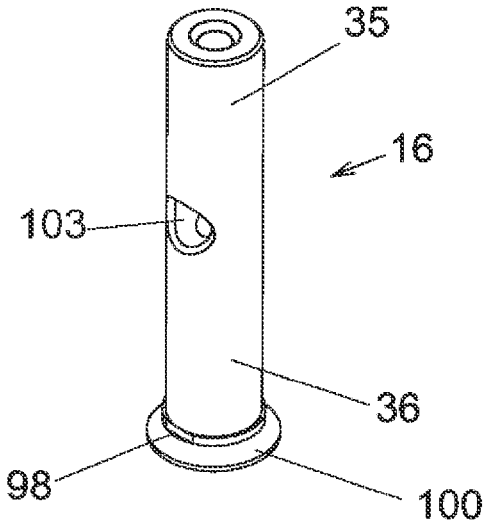
FIG. 10 shows a fourth embodiment of the intermediate part of a connection means.

FIG. 10 shows a fourth embodiment of the intermediate part 16 of a connection means, which, in its first end 35, is provided with a sleeve having an internal first thread and which, in its second end 36, is provided with a plane head 100. As alignment means, the intermediate part is provided with at least one orientation surface 98 connected to the head 100 in order to co-operate with a corresponding orientation surface in the plate hole of the outer plate. When the orientation surfaces of the head and the plate hole are facing each other, the fitter knows that the third thread 103 is aligned to receive and screw the element fixation means into the intermediate part 16.

Figure 11:
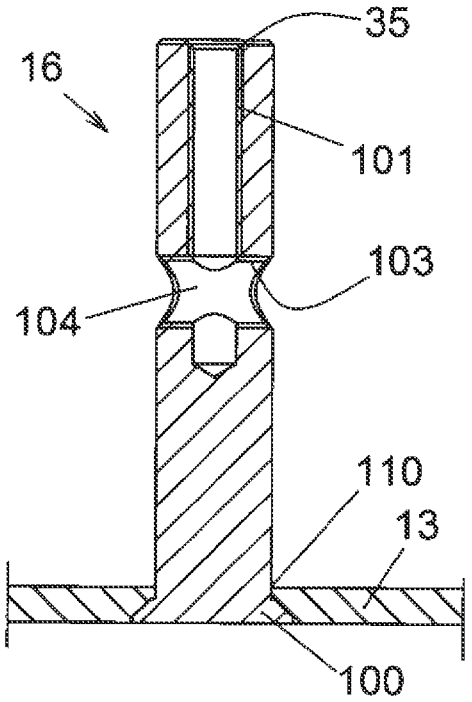
FIG. 11 shows an axial section through the intermediate part according to FIG. 10.

FIG. 11 shows the intermediate part in FIG. 10 in an axial section with the first thread 101 thereof as an internal thread in the first end 35 of the intermediate part 16. In addition, the third thread 103 of the intermediate part is shown, which is orientated perpendicular to the first thread in a through hole 104. The centre axis of the first thread 101 intersects the centre axis of the third thread 103. The intermediate part according to this embodiment may be provided with the corresponding locking screw that has been shown and described in connection with FIG. 9. The figure also shows that the head 100 of the intermediate part is mounted in the outer plate 13, the head only appearing as a circular ring from the outside. The head 100 of the intermediate part may also be manufactured with other shapes for said orientation in the plate hole 110 of the outer plate 13 in order to provide a form locking against turning.

Figure 12:
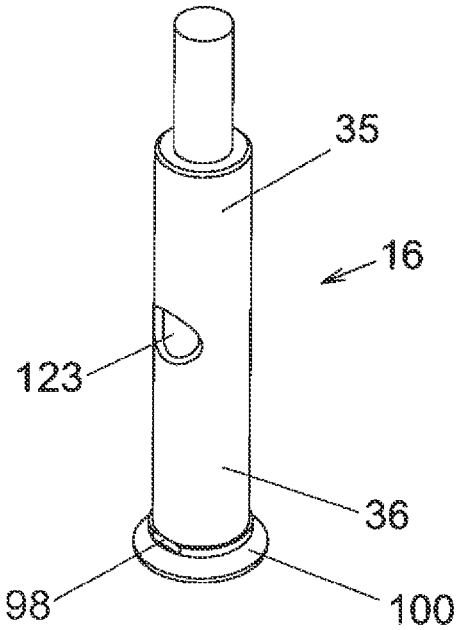
FIG. 12 shows a fifth embodiment of the intermediate part of a connection means.

FIG. 12 shows a fifth embodiment of the intermediate part 16 of a connection means, which, in its first end 35, is provided with a pin having an external first thread and which, in its second end 36, is provided with a plane head 100. As alignment means, the intermediate part is provided with at least one orientation surface 98 connected to the head 100 in order to co-operate with a corresponding orientation surface in the plate hole of the outer plate. When the orientation surfaces of the head and the plate hole are facing each other, the fitter knows that the third thread 123 is aligned to receive and screw the element fixation means into the intermediate part 16.

Figure 13:
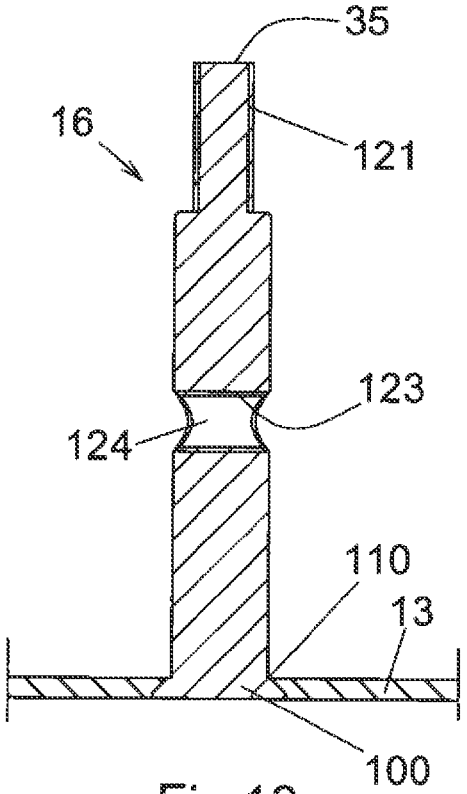
FIG. 13 shows an axial section through the intermediate part according to FIG. 12.

FIG. 13 shows the intermediate part in FIG. 12 in an axial section with the first thread 121 thereof as an external thread in the first end 35 of the intermediate part 16. In addition, the third thread 123 of the intermediate part is shown, which is orientated perpendicular to the first thread in a through hole 124. The centre axis of the first thread 101 intersects the centre axis of the third thread 123. The figure also shows that the head 100 of the intermediate part is mounted in the outer plate 13, the head only appearing as a circular ring from the outside. The head 100 of the intermediate part may also, as mentioned previously, be manufactured with other shapes for said orientation in the plate hole 110 of the outer plate 13 in order to provide a form locking against turning.

In these two latter described embodiments, as described previously, the first end 35 of the intermediate parts may also be provided with alignment means in the form of two screw driver slots instead of the shown orientation surfaces in connection with the head 100. As also is seen in FIGS. 11 and 13, the thickness of the outer plate may naturally be varied with the shape of the intermediate part being unaltered.

As has been described and shown in FIGS. 1-5, an element fixation means extends through the selvage and connects the third element, i.e., the lock housing, via the selvage with the intermediate part of the connection means and thereby also with the two plates on both sides of the door leaf. As has been shown in the figures, the element fixation means also extends through the intermediate part of a second connection means mounted in a corresponding way as the first connection means.

Figure 14:
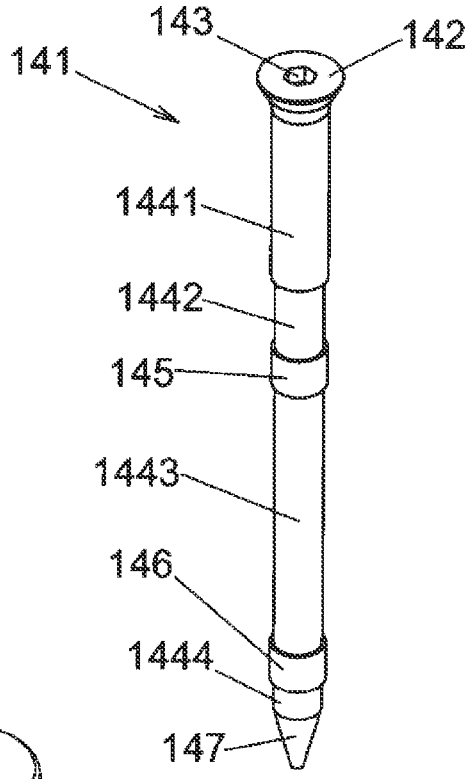
FIG. 14 shows an alternative embodiment of an element fixation means according to the invention.

FIG. 14 shows a first embodiment of an element fixation means 141 according to the invention having the same design as shown previously in FIGS. 1-3. In one end, the element fixation means is formed with a head 142 provided with a hex key grip 143. The head is connected to a smooth cylindrical shoulder 1441 of a greater diameter and having at least two smooth cylindrical portions of a smaller diameter. The figure shows three such smooth cylindrical portions 1442, 1443, 1444 of a smaller diameter. Between each such smooth cylindrical portion, a thread portion 145, 146 of a corresponding greater diameter is arranged, which is provided with an external thread fitting in the third internal thread of the intermediate part. The axial extension of the thread portions corresponds to or is slightly exceeding the diameters of the intermediate parts. The purpose of these limited threaded portions of the element fixation means is to increase the rapidity upon mounting of a lock. It is also possible to form the first threaded portion 145 with a greater diameter than the second threaded portion 146 in order to further increase the rapidity upon mounting. The other end of the element fixation means is formed with a cone 147 having the purpose of facilitating fitting in of the element fixation means into the intermediate parts.

Figure 15:
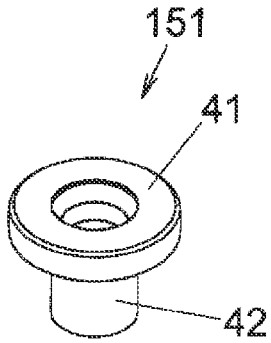
FIG. 15 shows a co-operation element for the element fixation means according to FIG. 14.

FIG. 15 shows a security head 151 formed with a collar 41 that is attached on a cylindrical spacing element 42 according to what has been shown in FIGS. 4-5. Correspondingly, the spacing element is arranged to abut against the selvage that is connected to the third element. This security head 151 may co-operate with the element fixation means described in FIG. 14 in order to provide a developed security technical function of the same.

Figure 16:
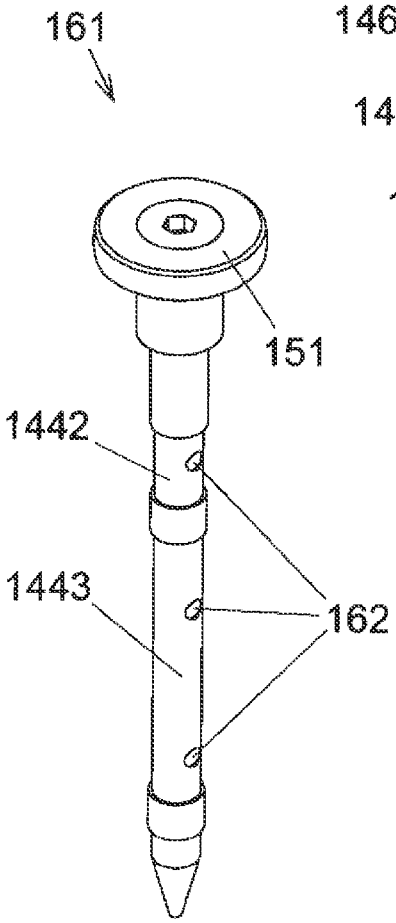
FIG. 16 shows the element fixation means and the co-operation element according to FIGS. 14 and 15 assembled.

FIG. 16 shows a second embodiment of an element fixation means 161 according to the invention having the same general design as shown previously in FIGS. 4-5. In this second embodiment, the security head 151 in FIG. 15 is rotatably mounted on the element fixation means shown in FIG. 14. The figure also shows that lock seats 162 may be arranged on the smooth cylindrical portions 1442, 1443 against which locking screws (not shown) can be screwed in and lock the element fixation means against rotation.

Figure 17:
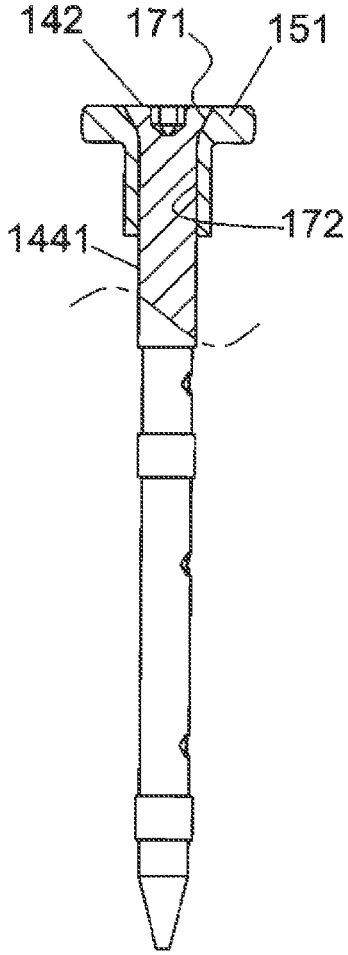
FIG. 17 shows a planar view partly in an axial section of FIG. 16.

FIG. 17 shows the element fixation means in FIG. 16 partly in an axial section, the security head 151 having a shape that is complementary to the head 142 and with rotationally symmetrical smooth internal surfaces 171, 172 so that the security head 151 can rotate freely on the smooth cylindrical shoulder 1441 connecting against the head. The security head 151 is outward axially locked against the head 142 via the conical smooth internal surface 171 and the corresponding conical surface of the head. The plane surfaces of the security head 151 and of the head 142 lie in the same plane in the end position of the security head shown.

By this rotatable security head, the element fixation means cannot be turned by a tool gripping around the security head because the same on that occasion only rotates around the cylindrical shoulder 1441.

The invention claimed is:

1. A lock mounting device comprising a lock connection device, which is arranged to connect a first element with a second element mounted on both sides of a door leaf between which elements and in said door leaf a third element is mounted, wherein the lock connection device is arranged to connect the first element with the second element, the lock connection device comprising:

a first screw means, which is provided with a threaded part intended to co-operate with a corresponding threaded part in a second screw means in order to provide an interconnection of the first element and the second element;

an intermediate part provided with a first thread in a first end of the intermediate part, the first thread arranged to co-operate with the first screw means for the connection to said first element, wherein the intermediate part is connected to the second element by a second end of the intermediate part, and the intermediate part is provided with a third thread orientated perpendicular to said first thread, the third element being mounted to the third thread of the intermediate part by an element fixation means, wherein the first element is an inner plate, the second element is an outer plate, and the third element is a lock housing having a selvage, wherein the selvage is connected to the intermediate part of the lock connection device by the element fixation means, in order to fix the lock housing, selvage, inner plate, and outer plate to each other in the door leaf, wherein the element fixation means is connected perpendicular to and through the selvage to the third thread of the intermediate part, and wherein the element fixation means is formed as a threaded screw arranged to be screwed into the third thread of the intermediate part, the head of the screw being formed with a collar situated outside the selvage, the collar being arranged to engagingly co-operate with a security striking plate mounted in a doorframe, by the collar being arranged to be inserted through a slot in the security striking plate in order to prevent a removal of the selvage from the security striking plate when the collar is inserted in the slot.

2. The lock mounting device according to claim 1, wherein the collar is cylindrically formed with a plane surface, and the collar is connected to a cylindrical spacing element outside the selvage, which spacing element has a diameter that exceeds the diameter of the screw thread.

3. The lock mounting device according to claim 2, wherein said collar and said spacing element constitute a security head that can rotate freely on the element fixation means.

4. A lock mounting device, comprising:

a first element located on a first side of a door leaf;

a second element located on a second side of the door leaf;

a third element surrounded by the first element and the second element inside the door leaf;

a plurality of lock connection devices arranged to connect the first element with the second element at respective corners of the first and second elements, each of the plurality of lock connection devices comprising:

a first screw means provided with a first threaded part;

an intermediate part comprising:

a first thread in a first end of the intermediate part, the first thread arranged to cooperate with the first threaded part of the first screw means for connecting the intermediate part to the first element;

a second end of the intermediate part adapted to cooperate with a corresponding second threaded part in a second screw means for connecting the intermediate part to the second element, wherein the first threaded part of the first screw means is adapted to cooperate with the second threaded part in the second screw means to provide an interconnection of the first element and the second element; and a third thread orientated perpendicular to said first thread, the third element being mounted to the third thread of the intermediate part by an element fixation means, wherein the element fixation means extends through at least two lock connection devices.

* * * * *